US006457912B1

(12) United States Patent
Leibl

(10) Patent No.: US 6,457,912 B1
(45) Date of Patent: Oct. 1, 2002

(54) FOUNDATION CONSTRUCTION USING RECYCLED TIRE WALLS

(76) Inventor: Ashley Leibl, 1450 Dublin Avenue, Winnipeg, Manitoba (CA), R3E 3K1

( * ) Notice: Subject to any disclaimer, the term of this patent is extended or adjusted under 35 U.S.C. 154(b) by 0 days.

(21) Appl. No.: 09/524,982

(22) Filed: Mar. 14, 2000

(30) Foreign Application Priority Data

Dec. 3, 1999 (CA) ..... 2291579

(51) Int. Cl.[7] ..... E01C 3/00

(52) U.S. Cl. ..... 405/302.4; 404/27; 404/28; 404/31; 404/40

(58) Field of Search ..... 405/229, 302.4, 405/238; 52/292, DIG. 9; 404/27, 28, 31, 40

(56) References Cited

U.S. PATENT DOCUMENTS 4,142,821 A * 3/1979 Doring ..... 405/258
4,801,217 A 1/1989 Goldberg
4,850,738 A 7/1989 Niemi
5,131,787 A 7/1992 Goldberg
5,393,166 A 2/1995 Stock et al.
5,511,899 A * 4/1996 Pavelek, II ..... 404/31
5,525,416 A * 6/1996 Katz et al. ..... 404/31
5,746,545 A 5/1998 Parker, Jr.
5,834,083 A 11/1998 Pignataro, Jr.
5,846,021 A 12/1998 Bailey et al.

* cited by examiner

*Primary Examiner*—Thomas B. Will
*Assistant Examiner*—Alexandra K. Pechhold
(74) *Attorney, Agent, or Firm*—Adrian D. Battison; Michael R. Williams; Ryan W. Dupuis

(57) ABSTRACT

A foundation and a method for constructing the foundation are provided using recycled automotive tires. A portion of the respective side walls of the tires are formed into flat annular members. The annular members are laid out on the ground in an overlapping arrangement to form a continuous substrate layer. The substrate layer is covered with an aggregate material for forming the foundation. The substrate layer prevents the aggregate material from penetrating into the soil while permitting drainage therethrough.

11 Claims, 2 Drawing Sheets

FOUNDATION CONSTRUCTION USING RECYCLED TIRE WALLS

FIELD OF THE INVENTION

This invention relates to a foundation construction wherein recycled tire walls are used to form a substrate layer for aggregate and concrete foundations.

BACKGROUND

When constructing foundations for roadways and other similar load bearing surfaces, it is common practice to layer the ground with aggregate material such as gravel. The aggregate material forms a stable base for the foundation. Under certain conditions however, the aggregate material is known to penetrate into the soil and lose stability over time. The use of a substrate layer between the aggregate material and the ground is known for distributing the loads supported on the foundation and for reducing the penetration of the aggregate material into the ground.

U.S. Pat. No. 5,846,021 to Bailey et al describes a road base construction wherein a plurality of recycled tire portions are coupled together to form a matrix for supporting aggregate thereon. The tire portions include a side wall and an adjacent portion of the tread of the tire such that when the tire portions are laid out on the ground the tread portion extends generally upward for coupling to adjacent tires. The loads are distributed between the tire portions through the couplings mounting them together. The ability of the matrix to distribute loads is thus dependent upon the strength of the couplings rather than the durability of the tires themselves.

SUMMARY

According to one aspect of the present invention there is provided a foundation comprising:

a layer of aggregate material supported on the ground; and a substrate layer located adjacent the ground supporting the aggregate material thereon such that the aggregate material is prevented from penetrating into the ground;

the substrate layer comprising a plurality of generally flat annular members comprising recycled side wall portions of automotive tires, the annular members being located in an overlapping arrangement such that each annular member overlaps at least one adjacent annular member, the annular members forming a substantially planar surface.

The use of side wall portions from recycled tires allows the members to be overlapped such that the loads are distributed across ground by the substrate layer without depending on couplings for securing the tires together and for distributing the loads therebetween.

The side wall portions are preferably located in the overlapping arrangement such that a circular opening defined within each annular member is substantially free from obstruction by the overlapping adjacent annular members for permitting drainage therethrough.

Each recycled portion may comprise a bead of the corresponding side wall or alternatively, a bead and an adjacent portion of the corresponding side wall.

A plurality of fasteners may be provided for coupling the annular members together adjacent an overlapping portion of each annular member.

According to a further aspect of the present invention there is provided a method of constructing a foundation using recycled automotive tires, said method comprising;

providing a plurality of automotive tires;

forming a plurality of generally flat annular members from respective side walls of the tires;

positioning the annular members in overlapping configuration such that the annular members form continuous substrate layer;

covering the annular members with aggregate material.

The method may include pouring concrete over the aggregate material.

Forming each annular member may comprise cutting a bead from a corresponding side wall of a tire. Alternatively, forming each annular member may comprise cutting a bead and an adjacent portion of the side wall from one of the tires.

The method may include fastening each annular member to at least one adjacent member before covering the members with aggregate material.

The annular members are preferably positioned such that a circular opening defined within each member is substantially free from obstruction from adjacent annular members to permit drainage through the substrate layer.

BRIEF DESCRIPTION OF THE DRAWINGS

In the accompanying drawings, which illustrate an exemplary embodiment of the present invention.

DETAILED DESCRIPTION

Figure 1:
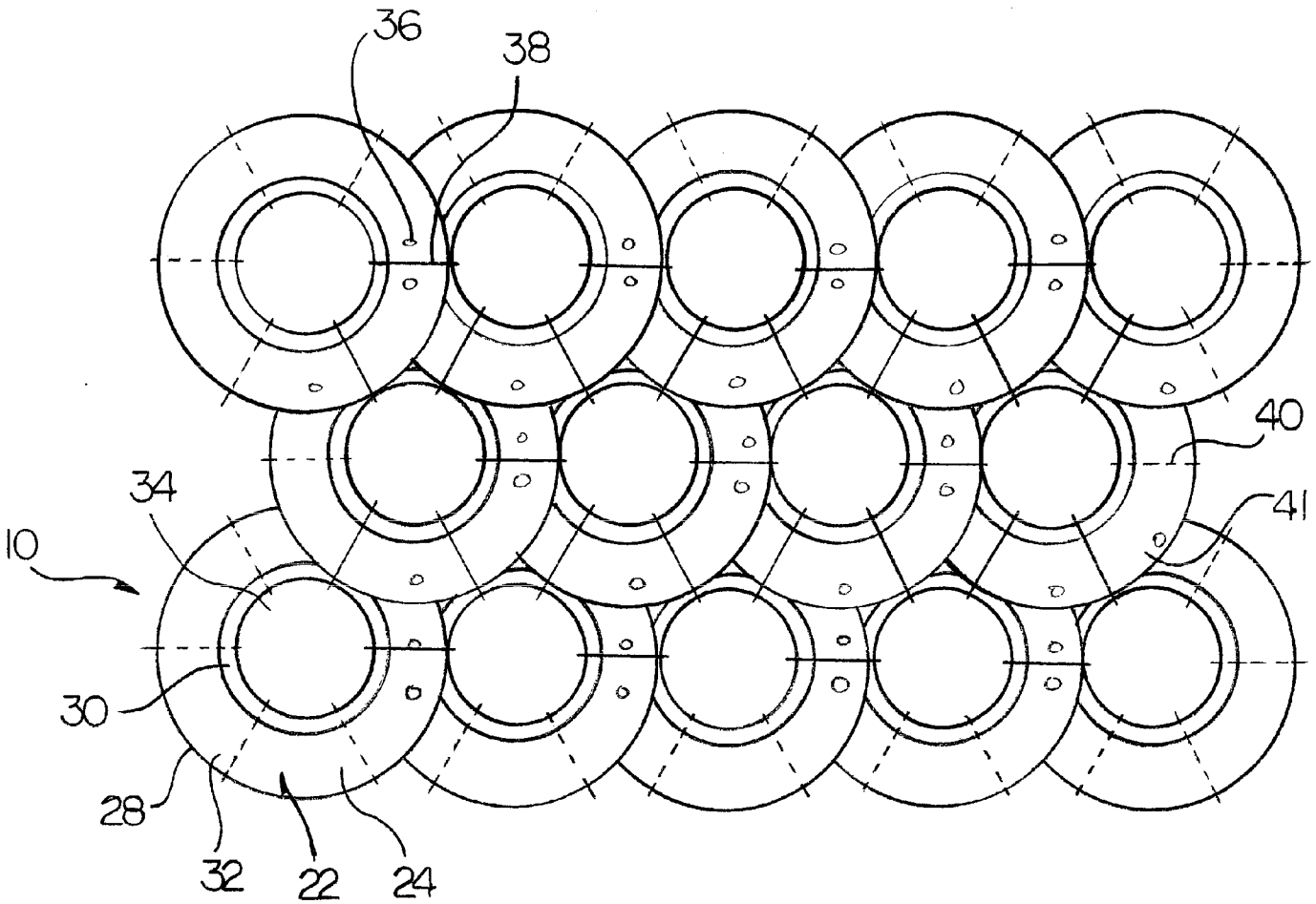
FIG. 1 is a top plan view of the substrate layer of recycled tires.
Figure 2:
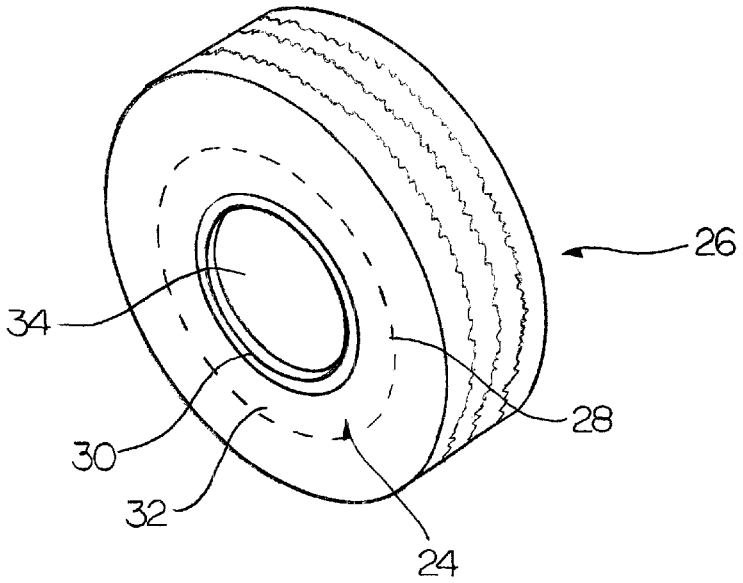
FIG. 2 is an isometric view of a tire indicating a portion of the tire which is used in the substrate layer.

Referring to the accompanying drawings, there is illustrated a substrate layer generally indicated by reference numeral 10 for use in constructing a foundation 12.

The foundation 12 is placed over the ground 14 for supporting loads thereon, such as the foundation on roadways or parking lots. The substrate layer 10 is placed directly over the ground 14 such that aggregate material 16 such as gravel may be placed thereon. Concrete 18 is then poured over the aggregate material to complete the foundation 12.

The substrate layer 10, acts to prevent the aggregate from penetrating into the ground 14. The substrate layer 10 accomplishes this by distributing the loads from the aggregate material 16 evenly over the ground 14 while permitting water to drain therethrough.

The substrate layer 10 comprises a substantially planar surface 20 formed from a plurality of generally flat and overlapping annular members 22 which are laid on the ground.

Each annular member 22 is formed from a respective side wall 24 of a recycled automotive tire 26. A circular cut 28 is formed within each side wall 24 of the tire when the members 22 are initially formed. The resulting annular member 22 includes a bead 30 and the side wall 32 of the tire.

A circular opening 34 is defined in the annular member 22 by the bead 30. A bead wire which extends through the bead 30 thus remains intact and covered for strength and durability of the resulting annular member which is formed.

The annular members 22 are positioned on the ground 14 in an overlapping arrangement along the planer surface 20. As seen from above in FIG. 1 the annular members 22 are laid out in an ordered and staggered pattern while the circular openings 34 defined within each annular member remains clear from obstruction from adjacent overlapping annular members to permit drainage of water therethrough. This creates an arrangement in which each side wall portion has portions lying on the ground and portions 41 overlapping with an already laid side wall.

The annular members 22 are secured together after laying by fasteners 36 which extend through the side wall portions 32 of the annular members such that each annular member 22 is secured to at least one adjacent annular member. The annular members 22 are further secured to adjacent annular members by a plurality of straps 38 which are arranged to extend around overlapping portions of the annular members.

In practice the annular members 22 are first formed from the recycled tires 26 by cutting each side wall 24 along the circular cut 28 to separate the bead. The annular members are then placed on the ground to form the substantially planar surface of the substrate layer 10. The annular members are placed in the ordered pattern with the circular openings 34 being uncovered as described above.

After the annular members have been placed on the ground separately, they may be secured as shown in FIG. 1 to adjacent annular members using the fasteners 36 and the straps 38. Once the substrate layer 10 has been formed the substrate layer may be covered with gravel or other similar aggregate material 16. Pouring concrete 18 over the aggregate material will thus form the foundation 12.

Figure 3:
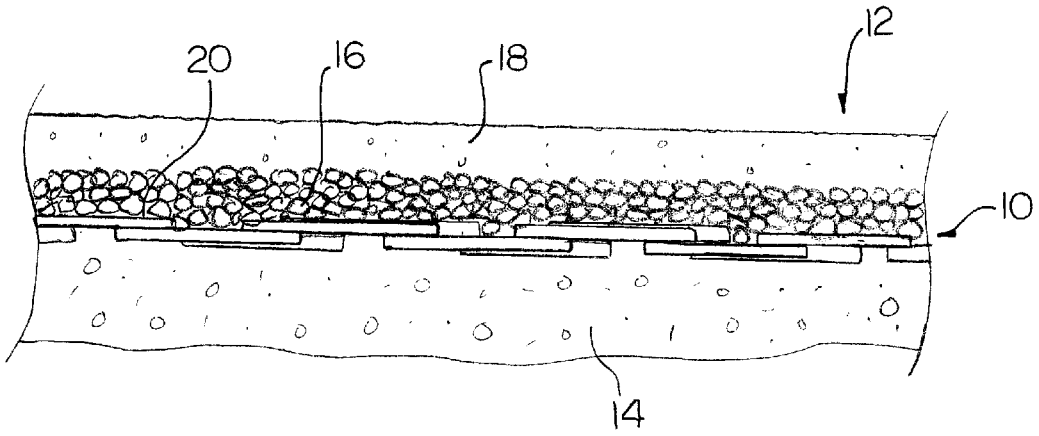
FIG. 3 is a cross sectional view of a foundation using the substrate layer of recycled tires.

In other embodiments the annular members may be laid out on the ground in any random pattern such that each annular member 22 overlaps at least one adjacent annular member. The use of fasteners 36 and straps 38 is optional, and no such fastenings and straps are shown in FIG. 3, because the overlapping arrangement of the annular members allows loads to be distributed evenly from the aggregate material 16 to the ground 14 in either case, with the side walls being held in place by their engagement with the ground and the aggregate.

While one embodiment of the present invention has been described in the foregoing, it is to be understood that other embodiments are possible within the scope of the invention. The invention is to be considered limited solely by the scope of the appended claims.

What is claimed is:

1. A method of constructing a foundation using recycled automotive tires, said method comprising;

providing a plurality of automotive tires each having a tread and two side walls, each side wall including an associated bead, where the side walls potions are interconnected by the tread;

cutting the tires to separate the tread from the two side walls to leave the two side walls each with its associated bead and each defining a flat annular member;

providing an area of ground to be covered by the foundation;

forming a single continuous substrate layer by:

laying on the ground the side walls so as when laid to form an overlapping pattern;

each sidewall as it is laid having at least one portion of a bottom surface thereof in contact with the ground and at least one portion of the bottom surface thereof overlapping an already laid sidewall;

an underside of the single continuous layer which is in contact with the ground being formed solely by the bottom surfaces of the side walls without the treads being located between the bottom surface and the ground;

and covering the substrate layer with an aggregate material.

2. The method according to claim 1 including pouring concrete over the aggregate material.

3. The method according to claim 1 including fastening each side wall to at least one adjacent side wall, after laying of the side walls, before covering the layer with aggregate material.

4. The method according to claim 1 including laying the side walls such that at least part of a circular opening defined within the bead thereof is free from obstruction from adjacent side walls to permit drainage through the substrate layer.

5. A method of constructing a foundation using recycled automotive tires, said method comprising;

providing a plurality of automotive tires each having a tread and two side walls, each side wall including an associated bead, where the side walls are interconnected by the tread;

cutting the tires to separate the tread from the two side walls to leave the two side walls each with its associated bead and each defining a flat annular member;

providing an area of ground to be covered by the foundation;

forming a single continuous substrate layer by:

laying on the ground the side walls so as when laid to form an overlapping pattern;

each side wall as it is being laid being separate from adjacent side walls;

each sidewall as it is laid having at least one portion of a bottom surface thereof in contact with the ground and at least one portion of the bottom-surface thereof overlapping an already laid sidewall;

an underside of the single continuous layer which is in contact with the ground being formed solely by the bottom surfaces of the side walls without the treads being located between the bottom surface and the ground;

and covering the substrate layer with an aggregate material.

6. The method according to claim 5 including pouring concrete over the aggregate material.

7. The method according to claim 5 including fastening each side wall to at least ones adjacent side wall, after laying of the side walls, before covering the layer with the aggregate material.

8. The method according to claim 5 including laying the side walls such that at least part of a circular opening defined within the bead thereof is free from obstruction from adjacent side walls to permit drainage through the substrate layer.

9. A method of constructing a foundation using recycled automotive tires, said method comprising;

providing a plurality of automotive tires each having a tread and two side walls, each side wall including an associated bead, where the side walls are interconnected by the tread;

cutting the tires to separate the tread from the two side walls to leave the two side walls each with its associated bead and each defining a flat annular member;

providing an area of ground to be covered by the foundation;

forming a single continuous substrate layer by:

laying on the ground the side walls so as when laid to form an overlapping pattern;

each sidewall as it is laid having at least one portion of a bottom surface thereof in contact with the ground and at least one portion of the bottom-surface thereof overlapping an already laid side-wall;

an underside of the single continuous layer which is in contact with the ground being formed solely by the bottom surfaces of the side walls without the treads being located between the bottom surface and the ground;

and covering the substrate layer with an aggregate material;

wherein the side walls are left without fastened connection each to the next so that the layer is maintained intact solely by the interconnection between the side walls, by the interconnection between the aggregate and the side walls and by the interconnection between the ground and the side walls.

10. The method according to claim 9 including pouring concrete over the aggregate material.

11. The method according to claim 9 including laying the side walls such that at least part of a circular opening defined within the bead thereof is free from obstruction from adjacent side walls to permit drainage through the substrate layer.

* * * * *